US010626555B2

(12) United States Patent
Gomi

(10) Patent No.: US 10,626,555 B2
(45) Date of Patent: Apr. 21, 2020

(54) SHEET MANUFACTURING APPARATUS

(71) Applicant: SEIKO EPSON CORPORATION, Tokyo (JP)

(72) Inventor: Katsuhito Gomi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 310 days.

(21) Appl. No.: 14/861,599

(22) Filed: Sep. 22, 2015

(65) Prior Publication Data

US 2016/0090690 A1 Mar. 31, 2016

(30) Foreign Application Priority Data

Sep. 25, 2014 (JP) ..... 2014-194909

(51) Int. Cl.
*D21F 9/00* (2006.01)
*D21F 3/00* (2006.01)

(52) U.S. Cl.
CPC . *D21F 9/00* (2013.01); *D21F 3/00* (2013.01)

(58) Field of Classification Search
CPC .... D21F 9/00; D21F 3/08; D21B 1/04; D21B 1/06; D21B 1/061; D21B 1/063; D21B 1/065; D21B 1/066; D21B 1/068; D21B 1/08; D21B 1/10
See application file for complete search history.

(56) References Cited

U.S. PATENT DOCUMENTS 5,422,710 A * 6/1995 Shirasaka ..... G03G 15/2064 219/216
5,641,374 A 6/1997 Peterson et al.
7,290,353 B2 * 11/2007 Yancey ..... C04B 18/241 162/55
8,882,965 B2 * 11/2014 Yamagami ..... D21B 1/08 162/261
8,986,505 B2 * 3/2015 Oguchi ..... B07B 1/00 162/259
9,039,868 B2 * 5/2015 Nagai ..... D21H 25/04 162/252

(Continued)

FOREIGN PATENT DOCUMENTS

EP 2664708 A1 * 11/2013 ..... D21B 1/08
JP 11-501878 2/1999

(Continued)

OTHER PUBLICATIONS

Robinson, "Paper and Pulp Chemistry and Technology of Papermaking; Chapter 7: Interfibrous Bonding" vol. 2, Feb. 1984.

*Primary Examiner* — Seyed Masoud Malekzadeh
(74) *Attorney, Agent, or Firm* — Workman Nydegger

(57) ABSTRACT

There is provided a sheet manufacturing apparatus including: a defibrating unit configured to defibrate a material including fibers in the air; a deposition unit configured to deposit at least a part of defibrated materials defibrated by the defibrating unit in the air; and a pressing unit configured to press a deposited material that is deposited by the deposition unit, in which the pressing unit includes a pair of pressing rollers that initially presses the deposited material, and among the pair of the pressing rollers, the pressing roller positioned at an upper portion is positioned on a downstream side of the pressing roller positioned at a lower portion in a horizontal component of a transfer direction of the deposited material.

7 Claims, 5 Drawing Sheets

(56) References Cited

U.S. PATENT DOCUMENTS

| | | | | |
|---|---|---|---|---|
| 9,045,857 | B2 * | 6/2015 | Gomi | D21B 1/068 |
| 9,045,858 | B2 * | 6/2015 | Gomi | D21D 5/24 |
| 9,074,320 | B2 * | 7/2015 | Gomi | D21F 3/08 |
| 2014/0027075 | A1 * | 1/2014 | Yamagami | D21B 1/08 162/4 |
| 2014/0290886 | A1 * | 10/2014 | Nagai | D21H 25/04 162/252 |
| 2014/0290887 | A1 * | 10/2014 | Gomi | D21B 1/063 162/252 |
| 2014/0290888 | A1 * | 10/2014 | Gomi | D21D 5/24 162/254 |
| 2015/0096703 | A1 * | 4/2015 | Fujita | B65H 29/125 162/286 |
| 2015/0096705 | A1 * | 4/2015 | Fujita | D04H 1/00 162/348 |
| 2015/0096706 | A1 * | 4/2015 | Gomi | D21F 3/08 162/358.1 |
| 2016/0229093 | A1 * | 8/2016 | Gomi | D04H 1/732 |

FOREIGN PATENT DOCUMENTS

| | | | | |
|---|---|---|---|---|
| JP | 2009-024305 | | | 2/2009 |
| JP | 2015-150707 | A | | 7/2010 |
| JP | 2012144819 | A | * | 8/2012 |

* cited by examiner

SHEET MANUFACTURING APPARATUS

BACKGROUND

1. Technical Field

The present invention relates to a sheet manufacturing apparatus.

2. Related Art

In the related art, a paper manufacturing method in which paper is paper-formed by a paper machine and the paper is transferred by being pressed by using a soft calender configured with a soft roller and a heating roller has been known (for example, JP-A-2010-150707).

However, in the paper manufacturing method in the related art, the soft calender is disposed so that a virtual line connecting the center of each roller of the soft calender is perpendicular to a transfer direction of paper. Therefore, the transferred paper stagnates in the inlet of a nip portion to be suspended due to the pressure of the nip portion by the soft calender, so that there is a problem in that transferring failure occurs.

SUMMARY

The present invention is carried out in order to solve at least a portion of the problems described above and is able to be realized as the following aspects or applied examples.

APPLICATION EXAMPLE 1

According to this application example, there is provided a sheet manufacturing apparatus including: a defibrating unit configured to defibrate a material including fibers in the air; a deposition unit configured to deposit at least a part of defibrated materials defibrated by the defibrating unit in the air; and a pressing unit configured to press a deposited material that is deposited by the deposition unit, in which the pressing unit includes a pair of pressing rollers that initially presses the deposited material, and among the pair of the pressing rollers, the pressing roller positioned at an upper portion is positioned on a downstream side of the pressing roller positioned at a lower portion in a horizontal component of a transfer direction of the deposited material.

According to this configuration, in the pair of pressing rollers that is disposed for initially pressing the deposited material, the upper pressing roller is positioned on the downstream side of the lower pressing roller in the transfer direction of the deposited material. Therefore, since the deposited material is transferred while facing the lower portion, gravity acts on the deposited material and thus the deposited material is easily transferred to a nip portion of the pair of pressing rollers. In addition, the deposited material is supported by the lower pressing roller, and thus it is possible to suppress that the deposited material is suspended to stagnate in the vicinity of an inlet of the nip portion of the pair of the pressing rollers and thus the deposited material is difficulty transferred.

APPLICATION EXAMPLE 2

In the sheet manufacturing apparatus according to the application example, when the pair of pressing rollers is viewed in a direction of a rotational central axis direction of the pair of pressing rollers, an angle formed by a vertical line and a line connecting each rotational central axis of the pair of pressing rollers may be 20 degrees to 90 degrees.

According to this configuration, by appropriately setting the angle formed by the vertical line and the virtual line connecting each rotational central axis of pressing rollers (virtual line passing through the center of each pressing roller), gravity efficiently acts on the deposited material efficiently acts, and thus it is possible to smoothly transfer the deposited material by the pair of pressing rollers.

APPLICATION EXAMPLE 3

In the sheet manufacturing apparatus according to the application example, the pair of pressing rollers may be rotated independently from each other.

According to this configuration, both the pressing rollers are rotated independently from each other, and both the pressing rollers transfer the deposited material. Therefore, it is possible to smoothly transfer the deposited material without breaking the shape of the deposited material.

APPLICATION EXAMPLE 4

In the sheet manufacturing apparatus according to the application example, a rotational speed of the pressing roller positioned at the upper portion may be faster than a rotational speed of the pressing roller positioned at the lower portion.

Due to the influence of gravity, it is more difficult for the upper side of the deposited material in a gravity direction to follow rotation of the pressing roller than the lower side of the deposited material. However, as the configuration described above, by making the rotational speed of the upper pressing roller faster, the upper side of the deposited material in the gravity direction can follow the rotation of the upper pressing roller, and thus it is possible to smoothly transfer the deposited material.

APPLICATION EXAMPLE 5

In the sheet manufacturing apparatus according to the application example, a friction coefficient of the pressing roller positioned at the upper portion may be greater than a friction coefficient of the pressing roller positioned at the lower portion.

Due to the influence of gravity, it is difficult for the upper side of the deposited material in the gravity direction to follow rotation of the pressing roller more than the lower side of the deposited material. However, as the configuration described above, by making the friction coefficient of the upper pressing roller greater, the upper side of the deposited material in the gravity direction can follow the rotation of the upper pressing roller, and thus it is possible to smoothly transfer the deposited material.

APPLICATION EXAMPLE 6

In the sheet manufacturing apparatus according to the application example, further comprises a guide member configured to guide the deposited material to the pair of pressing rollers, the guide member positioned on an upstream side of a portion that nips the deposited material in the transfer direction of the deposited material.

According to this configuration, since the deposited material is guided to the inlet of the nip portion of the pair of pressing rollers by following the guide member, it is possible to smoothly transfer the deposited material.

DESCRIPTION OF EXEMPLARY EMBODIMENTS

Hereinafter, first and second embodiments of the invention will be described with reference to the drawings. In addition, in each drawing, in order to illustrate each member to be visually recognized, the scales of the members are illustrated differently from the actual size.

First Embodiment

First, a configuration of a sheet manufacturing apparatus will be described. The sheet manufacturing apparatus is based on a technique of forming a new sheet Pr by using a raw material (defibration object) Pu such as a pure pulp sheet or used paper. According to the present embodiment, there is provided a sheet manufacturing apparatus including: a defibrating unit configured to defibrate a material including fibers in the air; a deposition unit configured to deposit at least a part of defibrated materials defibrated by the defibrating unit in the air; and a pressing unit configured to press a deposited material that is deposited by the deposition unit, in which the pressing unit includes a pair of pressing rollers that initially presses the deposited material, and among the pair of the pressing rollers, the pressing roller positioned at an upper portion is positioned on a downstream side of the pressing roller positioned at a lower portion in a horizontal component of a transfer direction of the deposited material. Hereinafter, the configuration of the sheet manufacturing apparatus will be described in detail.

Figure 1:
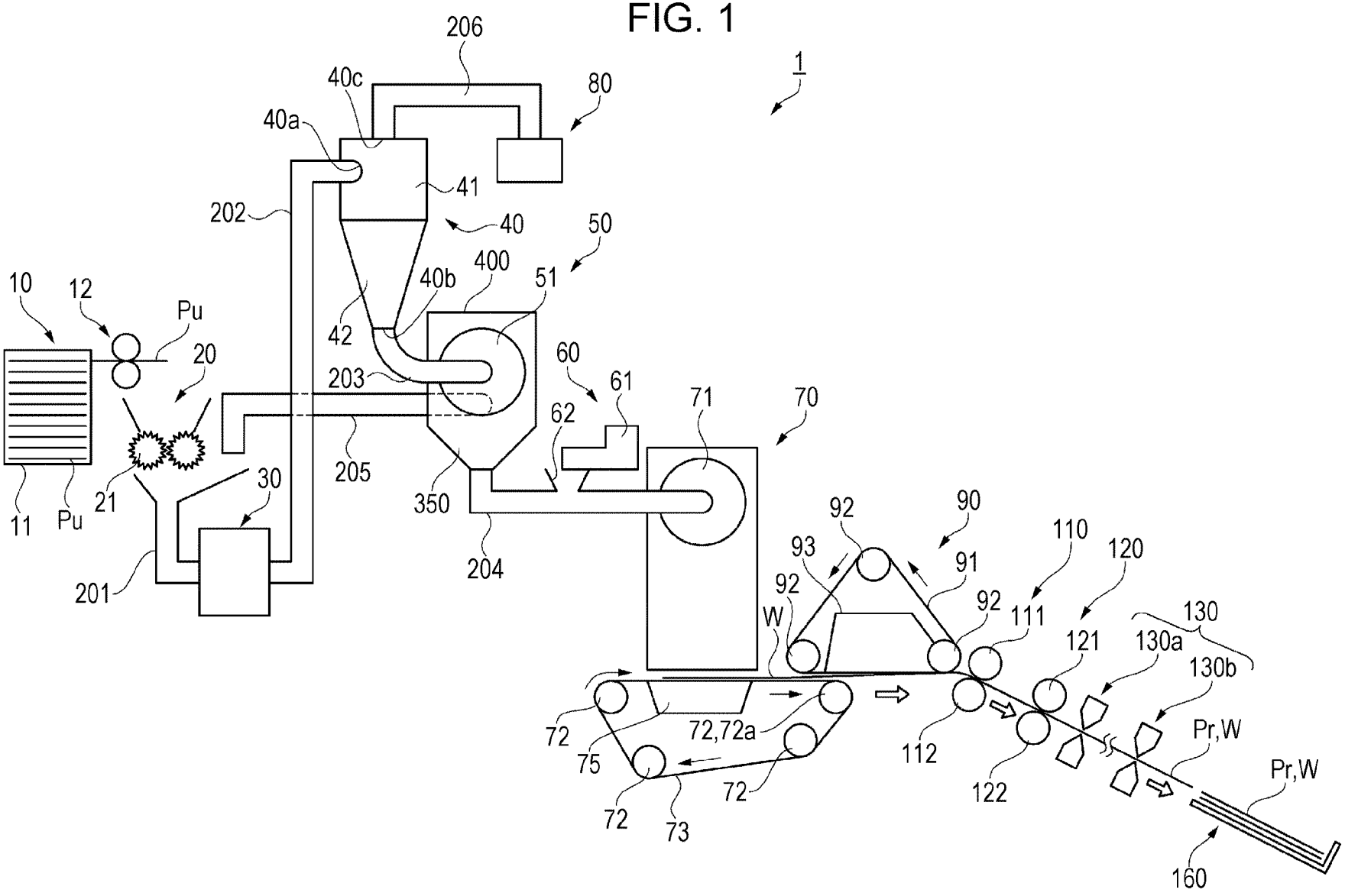
FIG. 1 is a schematic diagram illustrating a configuration of a sheet manufacturing apparatus according to a first embodiment.

FIG. 1 is a schematic diagram illustrating a configuration of a sheet manufacturing apparatus according to the present embodiment. As illustrated in FIG. 1, a sheet manufacturing apparatus 1 of the present embodiment includes a supplying unit 10, a crushing unit 20, a defibrating unit 30, a classifying unit 40, a screening unit 50, an additive agent feeding unit 60, a deposition unit 70, and a pressing unit 110.

The supplying unit 10 is configured to supply used paper Pu or the like to the crushing unit 20 as a raw material. The supplying unit 10 includes a tray 11 that stores a plurality of sheets of used paper Pu in a superimposed manner and an automatic feeding mechanism 12 that continuously feeds the used paper Pu in the tray 11 to the crushing unit 20. As the used paper Pu supplied to the sheet manufacturing apparatus 1, for example, there are paper sheets having A4 size, which have become mainstream at offices.

The crushing unit 20 is configured to cut out the supplied used paper Pu into pieces of paper of several centimeter square. The crushing unit 20 includes a crushing blade 21, and is configured as a device in which the cutting width of a blade of a general shredder is widened. Accordingly, it is possible to easily cut out the supplied used paper Pu into pieces of paper. The divided crushed paper is supplied to the defibrating unit 30 via a pipe 201.

The defibrating unit 30 is configured to defibrate a material including fibers in the air. Specifically, the defibrating unit 30 includes a rotary blade (not shown) that rotates, and performs defibration in which the crushed paper supplied from the crushing unit 20 is untangled to have a fiber type. In this application, the paper to be defibrated by the defibrating unit 30 is referred to as a defibration object, and the paper subjected to a process of the defibrating unit 30 is referred to as a defibrated material. Further, the defibrating unit 30 of the present embodiment performs dry defibration in the air. By the defibration process of the defibrating unit 30, materials used for coating sheets, such as printed ink or toner, and blur-preventing materials become grains having a size of several tens of μm or less (hereinafter, referred to as "ink grain") to be separated from the fibers. Accordingly, the defibrated materials subjected to the process of the defibrating unit 30 are fibers and ink grains which are obtained by the defibration of pieces of paper. In addition, a mechanism of generating an air flow by the rotation of the rotary blade is configured, and the defibrated material, which is subjected to the defibration, rides the air flow to be transferred to the classifying unit 40 via a pipe 202 in the air. Further, as necessary, an air-flow generating device which generates an air flow for transferring the defibrated material to the classifying unit 40 via the pipe 202 may be separately provided to the defibrating unit 30.

The classifying unit 40 is configured to classify an introduced material, which is introduced therein, by using an air flow. In the present embodiment, the defibrated material as the introduced material is classified into the ink grains and the fibers. The classifying unit 40 air-flow-classifies the transferred defibrated material into the ink grains and the fibers by applying, for example, a cyclone. Further, instead of the cyclone, any other type of airflow classifier may be used. In this case, as the airflow classifier other than the cyclone, for example, Elbow-jet or Eddie classifier is used. The airflow classifier generates a swirling air flow to perform separation and classification by using the difference of centrifugal force of the defibrated material according to the size and the density thereof. The airflow classifier can adjust classification-points by adjusting the speed of the air flow and the centrifugal force. Accordingly, the defibrated material is classified into the ink grains, which are relatively small and have low density, and the fibers, which are larger than the ink grains and have high density.

The classifying unit 40 of the present embodiment is a tangential inlet cyclone. The classifying unit 40 is configured with an introduction port 40*a* through which the introduced material is introduced from the defibrating unit 30, a cylindrical portion 41 to which the introduction port 40*a* is attached in a tangential direction, a conical portion 42 that continues from the lower portion of the cylindrical portion 41, a lower outlet port 40*b* that is provided at the lower portion of the conical portion 42, and an upper discharge port 40*c* that is provided at the center of the upper portion of the cylindrical portion 41 to discharge fine powders. The diameter of the conical portion 42 becomes decreased toward the lower portion in a vertical direction.

In the classification process, the air flow, which the defibrated material introduced through the introduction port 40*a* of the classifying unit 40 rides, is changed to circular motion at the cylindrical portion 41 and the conical portion 42, and thus the defibrated material receives centrifugal force to be classified. Then, the fibers which are larger than the ink grains and have high density are moved to the lower outlet port 40*b*, and, as the fine powders, the ink grains which are relatively small and have low density are led to the upper discharge port 40*c* along with the air. Thus, the ink grains are discharged from the upper discharge port 40*c* of the classifying unit 40. Further, the discharged ink grains are collected in a receiving unit 80 via a pipe 206 that is connected to the upper discharge port 40*c* of the classifying unit 40. Meanwhile, a classified material that includes the fibers classified from the lower outlet port 40*b* of the classifying unit 40 via a pipe 203 is transferred toward the screening unit 50 in the air. The classified material may be transferred from classifying unit 40 to the screening unit 50 by using the air flow used at the time of classification, or may be transferred from the classifying unit 40 positioned at the upper portion to the screening unit 50 positioned at the lower portion by gravity. A suction unit, which is for efficiently sucking a short-fiber mixture from the upper discharge port 40*c*, may be disposed at the upper discharge port 40*c* of the classifying unit 40, or the pipe 206. The classification is not accurately performed with a certain size or density as a boundary. Further, the material is not also accurately classified into the fibers and the ink grains. The relatively short fibers among the fibers are discharged from the upper discharge port 40*c* together with the ink grains. In addition, the relatively large ink grains among the ink grains are discharged from the lower outlet port 40*b* together with the fibers.

The screening unit 50 is configured to screen the classified material (defibrated material) including fibers classified by the classifying unit 40 by causing the material to pass through a sieving unit 51 that has a plurality of ports. Further, specifically, the classified material including fibers classified by the classifying unit 40 is screened as a passing-through material that passes through the port, and the residue that does not pass through the port. The screening unit 50 of the present embodiment includes a mechanism that disperses the classified material in the air by rotary motion. The passing-through material that has passed through the port by the screening of the screening unit 50 is transferred from a passing-through material transferring unit 350 toward the deposition unit 70 via a pipe 204. In contrast, the residue that does not pass through the port by the screening of the screening unit 50 returns to the defibrating unit 30 again via a pipe 205 as the defibration object. In this manner, the residue is reused (recycled) without being wasted.

The passing-through material that has passed through the port by the screening of the screening unit 50 is transferred to the deposition unit 70 via a pipe 204 in the air. The passing-through material may be transferred from the screening unit 50 to the deposition unit 70 by using a blower (not shown) that generates an air flow, or may be transferred from the screening unit 50 positioned at the upper portion to the deposition unit 70 positioned at the lower portion by gravity. An additive agent feeding unit 60 that adds an additive agent such as a bonding resin (for example, thermoplastic resin or thermosetting resin) to the transferred passing-through material may be provided in the pipe 204 between the screening unit 50 and the deposition unit 70. In addition, as the additive agent, in addition to the bonding resin, for example, a flame retardant, a whiteness improving agent, a sheet strength enhancing agent, a sizing agent, an absorption adjusting agent, an aromatic agent, and a deodorant may be fed. These additive agents are stored in an additive-agent storage unit 61 and fed through a feeding port 62 by a feeding mechanism (not shown).

The deposition unit 70 is configured to deposit at least a part of the defibrated materials that are defibrated by the defibrating unit 30 in the air. Specifically, the deposition unit deposits a material which includes the fibers and the bonding resin fed through the pipe 204 to form a web W. The deposition unit 70 includes a mechanism that uniformly disperses the fibers in the air and a mechanism that deposits the dispersed fibers on a mesh belt 73. In addition, the web W according to the present embodiment indicates a configuration form of an object including the fiber and the bonding resin. Accordingly, even when the form of the web, such as dimensions, is changed at the time of heating, pressing, cutting, and transferring the web, the object is indicated as the web.

As the mechanism that uniformly disperses the fibers in the air, a forming drum 71 into which the fiber and the bonding resin are fed is disposed in the deposition unit 70. Further, the bonding resin (additive agent) can be uniformly mixed with the passing-through material (fiber) by rotationally driving the forming drum 71. The forming drum 71 is provided with a screen having a plurality of pores. Further, along with uniform mixing of the bonding resin (additive agent) with the passing-through material (fiber) by rotationally driving the forming drum 71, the fiber has passed through the pore or the mixture of the fiber and the bonding resin can be uniformly dispersed in the air.

The endless mesh belt 73 on which mesh holes are formed is disposed below the forming drum 71. The mesh belt 73 is stretched by stretching rollers 72. Further, at least one of the stretching rollers 72 rotates, and thus the mesh belt 73 is moved in one direction.

In addition, as the suction unit that generates an air flow toward the lower portion in the vertical direction, a suction device 75 is provided below the forming drum 71 in the vertical direction through the mesh belt 73. The fibers dispersed in the air can be sucked on the mesh belt 73 by the suction device 75.

In addition, the fibers, which have passed the screen having pores of the forming drum 71, are deposited on the mesh belt 73 due to the sucking force of the suction device 75. At this time, a long deposited material (web W) including the fibers and the bonding resin can be formed by moving the mesh belt 73 in one direction. A strip-shaped continuous web W can be formed by sequentially performing the dispersion from the forming drum 71 and the movement of the mesh belt 73. The mesh belt 73 may be formed of metal, resin, or non-woven and may be formed of any materials as long as the fibers can be deposited on the material and the air flow can pass through the material. In addition, if the bore diameter of the mesh of the mesh belt 73 is too large, the fiber can be inserted into the mesh and the web W (sheet) becomes uneven when being formed. In contrast, if the bore diameter of the mesh is too small, it is difficult for the suction device 75 to form a stable air flow. Therefore, it is preferable to appropriately adjust (select) the bore diameter of the mesh. The suction device 75 has a closed box having a window of a desired size to be disposed under the mesh belt 73 and is configured to suck air from the portions other than the window, thereby causing the inside of the box to have a negative pressure compared to the outside air.

The web W formed on the mesh belt 73 is transferred in a transfer direction (a blank arrow in the drawing) by the rotational movement of the mesh belt 73. An intermediate transferring unit 90 is disposed on the upstream side of the mesh belt 73, and the web W on the mesh belt 73 is transferred toward the pressing unit 110 via the intermediate transferring unit 90. The intermediate transferring unit 90 is configured to be capable of transferring the web W while upwardly sucking the web W in the vertical direction (a direction in which the web W is separated from the mesh belt 73). The intermediate transferring unit 90 is disposed to be upwardly separated from the mesh belt 73 in the vertical direction (a direction perpendicular to the surface of the web W) and is disposed so that a part thereof deviates at the downstream side from the mesh belt 73 in the transfer direction of the web W. Further, a transfer section of the intermediate transferring unit 90 is from the stretching roller 72*a* on the downstream side of the mesh belt 73 to the pressing unit 110.

The intermediate transferring unit 90 includes a transfer belt 91, stretching rollers 92, and a suction chamber 93. The transfer belt 91 is an endless mesh belt on which mesh holes are formed and is stretched by the stretching rollers 92.

The suction chamber 93 is disposed in the transfer belt 91, and has a hollow box shape which includes an upper surface and four side surfaces in contact with the upper surface and of which the bottom surface (a surface facing the transfer belt 91 positioned at the lower portion) is opened. In addition, the suction chamber 93 includes the suction unit that generates an air flow (sucking force) in the suction chamber 93. Further, the space in the suction chamber 93 is sucked by driving the suction unit and thus the air flow flows in through the bottom surface of the suction chamber 93. Accordingly, the air flow is upwardly generated in the suction chamber 93, and thus it is possible to cause the web W to adhere to the transfer belt 91 by sucking the web W from above. In addition, the transfer belt 91 is moved (rounded) by auto-rotation of the stretching roller 92, and thus it is possible to transfer the web W toward the pressing unit 110. Further, since a part of the suction chamber 93 overlaps with the mesh belt 73 when viewed from above and the suction chamber 93 is disposed at a position on the downstream side so as not to overlap with the suction device 75, it is possible to cause the web W on the mesh belt 73 to adhere to the transfer belt 91 by peeling off the web W from the mesh belt 73 at a position facing the suction chamber 93. The stretching roller 92 auto-rotates such that the transfer belt 91 is moved at the same speed as that of the mesh belt 73. If there is a difference in speed between the mesh belt 73 and the transfer belt 91, the web W is stretched to be broken or bent; however, such a problem can be prevented by making both the belts to have the same speed.

The pressing unit 110 is configured to press the web W as the deposited material that is deposited by the deposition unit 70. The pressing unit 110 is configured to have a pair of pressing rollers 111 and 112 and initially presses the web W. That is, the sheet manufacturing apparatus 1 is configured not to include any other pressing unit (for example, another pair of pressing rollers) for pressing the web W formed by the deposition unit 70 between the deposition unit 70 and the pressing unit 110. Further, the pressing unit 110 of the present embodiment presses the web W so that the thickness of the web W is changed to be in a range of about ⅕ to 1/30 of the thickness of the web W formed by the deposition unit 70. Accordingly, a configuration in which a single roller or a transfer belt for simply transferring the web W is disposed between the deposition unit 70 and the pressing unit 110 may be adopted. In addition, a configuration in which a pair of rollers for slightly pressing the web W (with a pressure of falling short of pressing the web W to have the thickness described above) is disposed may be adopted. Further, the pressing unit 110 presses the web W transferred by the intermediate transferring unit 90 by interposing the web W between the pair of pressing rollers 111 and 112. It is possible to improve the strength of the web W by pressing the web W. The detailed configuration of the pressing unit 110 will be described below.

A heating unit 120 is disposed on the downstream side of the pressing unit 110 in the transfer direction. The heating unit 120 is configured to bond the fibers included in the web W by using the bonding resin. The heating unit 120 of the present embodiment is configured to have a pair of heating rollers 121 and 122. A heating member such as a heater is provided in the center portion of the rotational axis of the heating rollers 121 and 122, and the web W is transferred while being interposed between the pair of heating rollers 121 and 122, thereby heating and pressing the web W. Further, by heating and pressing the web W, the bonding resin is melted to be easily tangled with the fibers and the distance between the fibers becomes short so that the contact point between the fibers is increased. Accordingly, the density is increased to improve the strength of the web W.

As a cutting unit 130 that cuts the web W, a first cutting unit 130*a* that cuts the web W in a direction perpendicular to the transfer direction of the web W, and a second cutting unit 130*b* that cuts the web W along the transfer direction of the web W are disposed on the downstream side of the heating unit 120 in the transfer direction. The first cutting unit 130*a* includes a cutter, and cuts out the continuous web W to have a sheet shape according to cutting positions set with a predetermined length. The second cutting unit 130*b* includes a cutter, and cuts out the web W according to the cutting position in the transfer direction of the web W. Accordingly, a sheet Pr (web W) of a desired size is formed. The cut sheet Pr is stacked on a stacker 160. In addition, a configuration in which the continuous web W is wound in a roll shape by a winding roller without being cut may be adopted. In this manner, the sheet Pr can be manufactured in the sheet manufacturing apparatus 1.

In addition, the sheet according to the present embodiment indicates mainly paper which has a sheet shape and includes fibers, such as used paper or pure pulp, as a raw material. However, the sheet is not limited thereto and may have a board shape or a web shape (or a shape having unevenness). In addition, as the raw materials, a plant fiber such as cellulose, a chemical fiber such as polyethylene terephthalate (PET) or polyester, or an animal fiber such as wool or silk may be used. The sheet in the present application is classified into paper and non-woven. The paper includes one having a thin sheet shape, and includes recording paper used for making a note or printing, wall paper, wrapping paper, colored paper, Kent paper, and the like. Non-woven is thicker than paper or has a strength lower than that of paper. Non-woven includes non-woven, fiber board, tissue paper, paper towel, cleaner, a filter, a liquid absorbing material, a sound absorbing body, a buffer material, a mat, and the like.

In addition, the used paper according to present embodiment indicates mainly printed paper, but if it is formed as paper to be used as the raw material, it is referred to as used paper regardless of being used once.

Figure 2:
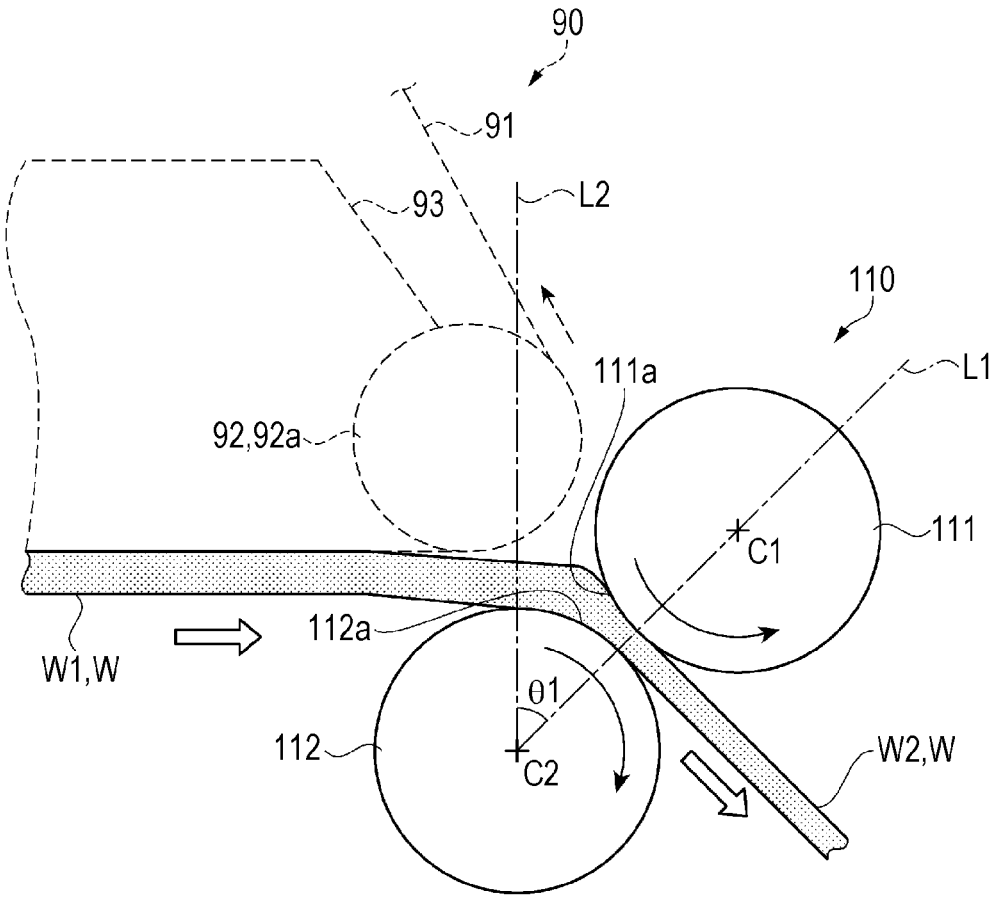
FIG. 2 is a schematic diagram illustrating a configuration of a pressing unit according to the first embodiment.

Next, the configuration of the pressing unit will be described. FIG. 2 is a schematic diagram illustrating the configuration of the pressing unit. The pressing unit 110 initially presses the web W that is deposited by the deposition unit 70 and includes the pair of pressing rollers 111 and 112. Further, the pair of pressing rollers 111 and 112 is configured to have a first pressing roller 111 as a pressing roller positioned at the upper portion and a second pressing roller 112 as a pressing roller positioned at the lower portion. In addition, in the pair of pressing rollers 111 and 112, the definition, which defines the first pressing roller 111 as a pressing roller positioned at the upper portion and the second pressing roller 112 as a pressing roller positioned at the lower portion, is that the pressing roller positioned relatively at the upper portion is the first pressing roller 111 and the pressing roller positioned relatively at the lower portion is the second pressing roller 112 when the pair of pressing rollers 111 and 112 is seen from the front surface of the web W pressed by the pair of pressing rollers 111 and 112, in the transfer direction. The first pressing roller 111 is in contact with the upper surface of the web W, and the second pressing roller is in contact with the lower surface of the web W.

In addition, the first pressing roller 111 is configured to be positioned on a downstream side of the second pressing roller 112 in a horizontal component of the transfer direction of the web W. A web W1 indicates a web that is on the upstream side of the pressing unit 110 and is not yet compressed, a web W2 indicates a web that is compressed by being passed through the pressing unit 110 and is on the downstream side of the pressing unit 110, and the thickness of the web W2 is smaller than that of the web W1. Further, in the present embodiment, the web W transferred from the intermediate transferring unit 90 in a substantially horizontal direction is transferred in an oblique downward direction by being passed through the pressing unit 110 that is obliquely disposed as illustrated in FIG. 2. In this manner, the transfer direction of the web W is changed between the upstream side and the downstream side of the pressing unit 110. Therefore, the position of the pair of pressing rollers 111 and 112 is defined according to the horizontal component in the transfer direction of the web W. The transfer direction of the web W1 is a right direction in FIG. 2 and the transfer direction of the web W2 is an oblique right direction in FIG. 2. Therefore, the horizontal component of the transfer direction of each of the webs W1 and W2 is a right direction in FIG. 2 and can be defined as the same direction. Specifically, a rotational central axis C1 of the first pressing roller 111 is positioned on the downstream side of a rotational central axis C2 of the second pressing roller 112 in the horizontal component in the transfer direction of the web W. In addition, in the present embodiment, the timing of the second pressing roller 112 coming in contact with the web W is earlier than the timing of the first pressing roller 111 coming in contact with the web W, as illustrated in FIG. 2. That is, a surface 112*a* of the second pressing roller 112, which comes in contact with the web W, is positioned on the upstream side of a surface 111*a* of the first pressing roller 111, which comes in contact with the web W, in the transfer direction of the web.

Further, when the pressing rollers 111 and 112 are viewed in a direction of the rotational central axes C1 and C2 of the pair of pressing rollers 111 and 112, an angle A formed by a vertical line L2 and a line L1 (a virtual line that connects the rotational central axes 11 and 12) passing through the center of the pressing rollers 111 and 112 is 20 degrees to 90 degrees. In this manner, the line L1 that connects the rotational central axes C1 and C2 of the pressing rollers 111 and 112 is positioned to be inclined with respect to the vertical line L2 that passes through the rotational central axis C2 of the second pressing roller 112 (or the rotational central axis C1 of the first pressing roller 111) such that the upper side of the line L1 (the first pressing roller 111 side) is positioned on the downstream side of the lower side of the line L1 (the second pressing roller 112 side) in the horizontal component in the transfer direction of the web W. The pair of pressing rollers 111 and 112 is disposed so that the line L1 has such a relationship with respect to the vertical line L2.

In addition, since the pair of pressing rollers 111 and 112 is disposed at such a position, a space area is formed on the upper side of the second pressing roller 112. Thus, a part of the intermediate transferring unit 90 can be disposed in the space area. Specifically, a stretching roller 92*a* on the downstream side of the intermediate transferring unit 90 is disposed in the space area on the upper side of the second pressing roller 112. The sucking force that acts on the web W by the intermediate transferring unit 90 is decreased at a position where the web W is transferred to be close to the pressing unit 110, and thus, a part of the web W falls in the gravity direction from the transfer belt 91. At this time, the fallen part of the web W is supported by the upper surface 112*a* in the vertical direction of the second pressing roller 112. Accordingly, the web W transferred from the intermediate transferring unit 90 can be securely transferred by the pressing unit 110. Further, the pressing unit 110 according to the present embodiment presses and compresses the web W so that the thickness of the web W (W2) after pressing is about ⅕ to 1/30 of the thickness of the web W (W1) before pressing. In addition, the pair of pressing rollers 111 and 112 is described to be a roller that initially presses the web W, but is not limited thereto. A pair of rollers used for transfer may be disposed on the upstream side of the pair of pressing rollers 111 and 112. Such a pair of transfer rollers is not used for pressing, and thus the thickness of the web W is slightly changed by being passed through the pair of transfer rollers. The pair of pressing rollers 111 and 112 of the present application may be defined as a pair of rollers which changes the thickness of the web W in a range of ⅕ to 1/30 of the thickness of the web W before pressing.

In addition, the first pressing roller 111 and the second pressing roller 112 are rotated independently from each other. Specifically, motors are respectively connected to the first pressing roller 111 and the second pressing roller 112 as driving sources, and the first pressing roller 111 (a counter-clockwise direction in FIG. 2) and the second pressing roller 112 (clockwise direction in FIG. 2) can be respectively rotated by driving each motor. In this manner, idling of the first pressing roller 111 or the second pressing roller 112 at the time of transferring the web W can be suppressed, and therefore, the web W can be smoothly transferred. Further, in this case, it is preferable that the rotational speed of the first pressing roller 111 is faster than the rotational speed of the second pressing roller 112. For example, controlling of the driving is performed so that the rotational speed of the first pressing roller 111 is faster than the rotational speed of the second pressing roller 112 by about 0.01% to 2%. Accordingly, the web W can follow the rotation of the first pressing roller 111, and thus the web W can be easily guided to the nip portion of the first pressing roller 111 and the second pressing roller 112.

According to the present embodiment, the following effects can be obtained.

The web W (deposited material) that is deposited by the deposition unit 70 is initially pressed by the pair of a first pressing roller 111 and a second pressing roller 112. Here, the first pressing roller 111 positioned at the upper portion is positioned on the downstream side of the second pressing roller 112 positioned at the lower portion in the transfer direction of the web W (W1). Therefore, since the web W (W1) is transferred downward by the first pressing roller 111 and the second pressing roller 112, gravity acts on the transferred web W (W1), and thus the web W is easily transferred by the first pressing roller 111 and the second pressing roller 112. In addition, the web W (W1) is supported by a part of the second pressing roller 112 positioned at the lower portion, and thus it is possible to suppress that the web W (W1) is suspended to stagnate in the vicinity of an inlet of the nip portion and thus the web W is difficulty transferred.

Further, the first pressing roller 111 and the second pressing roller 112 are rotated independently from each other. At this time, the rotational speed of the first pressing roller 111 positioned at the upper portion is set to be faster than the rotational speed of the second pressing roller 112 positioned at the lower portion. Accordingly, the web W (W1) on the upper side in the gravity direction is also securely transferred and follows the rotation of the first pressing roller 111, and therefore, the web W (W1) can be smoothly transferred.

Second Embodiment

Next, a second embodiment will be described. The basic configuration of a sheet manufacturing apparatus according to the present embodiment is the same as that of the sheet manufacturing apparatus 1 according to the first embodiment, and thus the description will not be repeated. The configuration different from the configuration of the first embodiment, that is, the configuration of the pressing unit will be mainly described.

Figure 3:
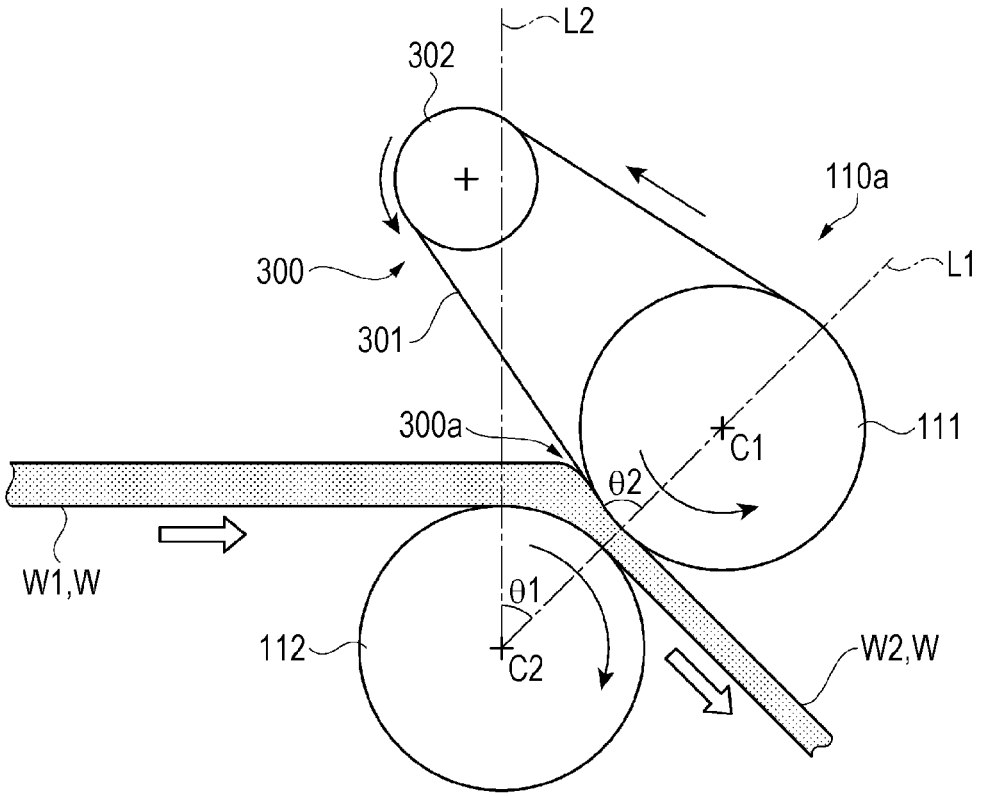
FIG. 3 is a schematic diagram illustrating a configuration of a pressing unit according to a second embodiment.

As illustrated in FIG. 3, a pressing unit 110*a* according to the present embodiment includes the pair of pressing rollers 111 and 112 that initially presses the web W. Among the pair of pressing rollers 111 and 112, the first pressing roller 111 positioned at the upper portion is positioned on the downstream side of the second pressing roller 112 positioned at the lower portion in the horizontal component of the transfer direction of the web W. Further, a guide member 300 that guides the web W to the pair of pressing rollers 111 and 112 is provided on the upstream side of a portion (nip portion) that nips the web W, in the transfer direction of the web W.

The guide member 300 according to the present embodiment includes a guide belt 301 and a stretching roller 302. The guide belt 301 is an endless belt and is stretched by the stretching roller 302 and the first pressing roller 111. In addition, the guide belt 301 is configured to rotationally move along the rotation of the first pressing roller 111.

Further, a part of the guide belt 301 that is disposed at a position corresponding to the inlet of the nip portion of the pair of pressing rollers 111 and 112 functions as a guide portion 300*a* that guides the web W (W1) to the nip portion. In addition, an angle θ2 formed by the line L1 passing through the center of the pair of pressing rollers 111 and 112 and the guide belt 301 corresponding to the guide portion 300*a* is set to be about 90 degrees.

According to the present embodiment, the following effects can be obtained in addition to the effects of the first embodiment.

The web W (W1) deposited by the deposition unit 70 is transferred by the guide portion 300*a* of the guide member 300 that is disposed at a position corresponding to the inlet of the nip portion configured by the first pressing roller 111 and the second pressing roller 112. Accordingly, the web W (W1) can be smoothly transferred without a part of the web W (W1) in the inlet of the nip portion stagnating.

The present invention is not limited to the above embodiments and can apply various changes or improvement to the above embodiments. A modification example will be described. The modification example can be combined.

Modification Example 1

Figure 4:
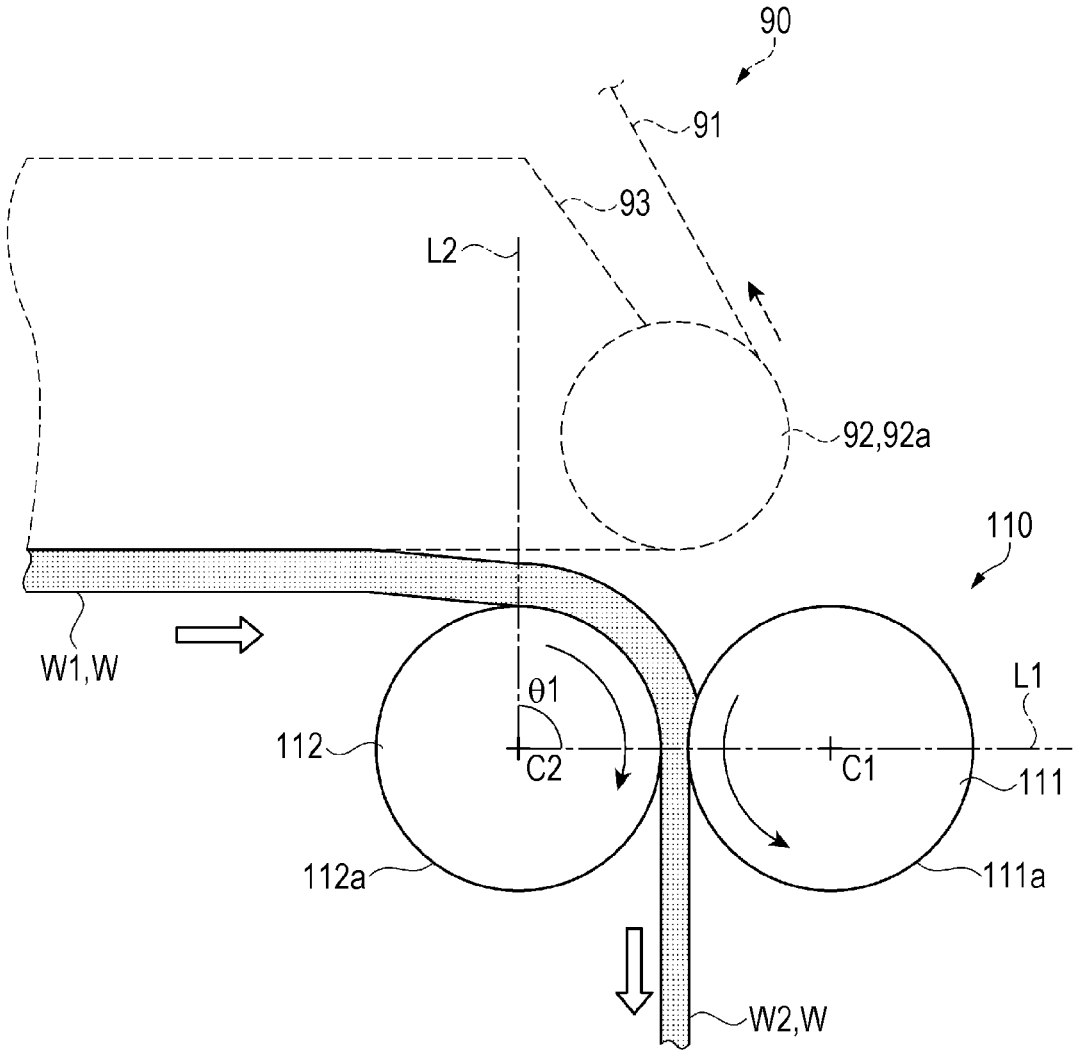
FIG. 4 is a schematic diagram illustrating a configuration of a pressing unit according to a modification example.

In the above embodiments, a case in which the angle θ1 formed by the vertical line L2 and the line L1 passing through the center of the pair of pressing rollers 111 and 112 is relatively small is described, but the invention is not limited thereto. The angle is preferably 90 degrees or smaller. FIG. 4 is a schematic diagram illustrating the configuration of the pressing unit according to the modification example. As illustrated in FIG. 4, when the pressing rollers 111 and 112 are viewed in a direction of the rotational central axes C1 and C2 of the pair of pressing rollers 111 and 112 of the pressing unit 110, the angle θ1 formed by the vertical line L2 and the line L1 passing through the center of the pressing rollers 111 and 112 is about 90 degrees. In this manner, the web W is transferred downward by the pair of pressing rollers 111 and 112, gravity acts on the transferred web W at maximum, and thus the web W is easily transferred by the pair of pressing rollers 111 and 112.

Further, the first pressing roller 111 and the second pressing roller 112 are disposed in parallel with each other in an approximately horizontal direction, and thus a wide space area is formed on the upper side of the second pressing roller 112. Therefore, a stretching roller 92*a* on the downstream side of the intermediate transferring unit 90 can be disposed further close to the first pressing roller 111 side. Accordingly, the web W that is fallen in the gravity direction because the action of the sucking force by the intermediate transferring unit 90 is decreased can be supported by a wide range.

In addition, in FIG. 4, since the transfer direction of the web W2 is substantially the vertical direction, there is no horizontal component. In this case, by using the horizontal component in the transfer direction of the web W1, the first pressing roller 111 is defined as the downstream side.

Modification Example 2

Figure 5:
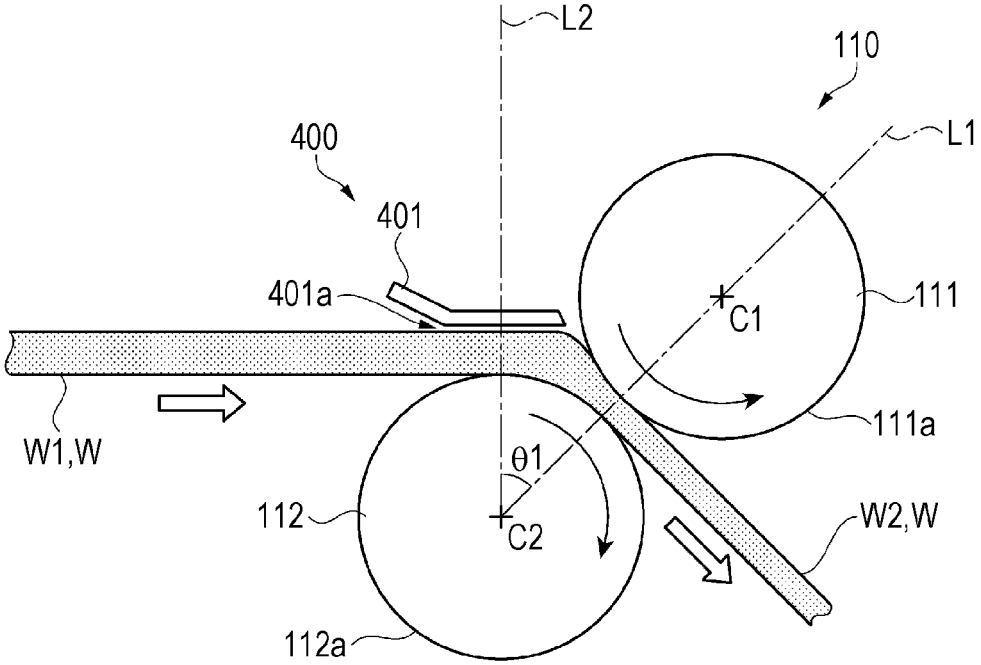
FIG. 5 is a schematic diagram illustrating a configuration of a pressing unit according to another modification example.

In the second embodiment described above, the guide member 300 includes the guide belt 301, but the invention is not limited to the configuration. The guide member may be configured by a guide (for example, a guide plate) that simply guides the web W (W1). FIG. 5 is a schematic diagram illustrating the configuration of the pressing unit according to another modification example. As illustrated in FIG. 5, a guide member 400 includes a guide 401 that is disposed on the upstream side of a portion nipped by the pair of pressing rollers 111 and 112 in the transfer direction of the web W. The guide 401 includes a guide portion 401*a* that is disposed at a position corresponding to the inlet of the nip portion, and has a guiding surface that guides the web W (W1) to the nip portion. In this manner, the web W (W1) deposited by the deposition unit 70 is transferred (guided) by the guide portion 401*a* of the guide 401 of the guide member 400 disposed at a position corresponding to the inlet of the nip portion configured by the first pressing roller 111 and the second pressing roller 112. Accordingly, the web W (W1) can be smoothly transferred without causing a part of the web W to stagnate in the inlet of the nip portion.

Modification Example 3

In the embodiments described above, the rotational speed of the first pressing roller 111 of the pressing unit 110 is set to be faster than the rotational speed of the second pressing roller 112, but the invention is not limited to the configuration. For example, a configuration in which the friction coefficient of the first pressing roller 111 is greater than the friction coefficient of the second pressing roller 112 may be adopted. Specifically, for example, hard chrome plating or electroless nickel plating is performed on the surface portion of the second pressing roller 112 by using a metal material. As an elastic material, a cotton material or a rubber material is used for the first pressing roller 111. As the rubber material, urethane rubber, silicone rubber, or ethylene propylene diene rubber (EPDM) is used. In this manner, the web W can be uniformly transferred to the nip portion of the first pressing roller 111 and the second pressing roller 112 by the difference of friction force occurring in the surface of the first pressing roller 111 and the surface of the second pressing roller 112.

Modification Example 4

In the embodiments described above, the configuration of the pair of pressing rollers 111 and 112 that initially presses the web W deposited by the deposition unit 70 is described, but another pair of pressing rollers may be provided on the downstream side of the pair of pressing rollers 111 and 112. In this case, similar to the pair of pressing rollers 111 and 112, the other pair of pressing rollers is configured so that the pressing roller positioned at the upper portion is positioned the downstream side of the pressing roller positioned at the lower portion in the horizontal component of the transfer direction of the web W. In this manner, the web W (W2) transferred by the pair of pressing rollers 111 and 112 can be smoothly transferred by the other pair of pressing rollers.

Modification Example 5

In the embodiments described above, the pressing unit 110 and the heating unit 120 are individually disposed, but the invention is not limited to the configuration. At least one of the first pressing roller 111 and the second pressing roller 112 of the pressing unit 110 may be heated. The pressing unit 110 may be heated or not be heated as long as the pressing unit can perform pressing. In this manner, the configuration of the apparatus can be simplified.

Modification Example 6

In the embodiments described above, the first pressing roller 111 and the second pressing roller 112 have the same roller diameter, but the invention is not limited to the configuration. The first pressing roller 111 and the second pressing roller 112 may be appropriately set to have different diameters. In this manner, the degree of freedom for the layout of the apparatus can be improved.

Modification Example 7

In the embodiments described above, the intermediate transferring unit 90 is provided which transfers the web W formed on the mesh belt 73 while sucking the web W, but the invention is not limited to the configuration. For example, a scraper may be disposed instead of the intermediate transferring unit 90. Even in this configuration, the web W formed on the mesh belt 73 can be transferred to the pressing unit 110 while being peeled off, and the configuration of the apparatus can be simplified.

Modification Example 8

In the embodiments described above, the first pressing roller 111 and the second pressing roller 112 are configured to be rotated independently from each other, but the invention is not limited to the configuration. Among the first pressing roller 111 and the second pressing roller 112, one roller may be a driving roller that rotationally drives and the other roller may be a driven roller that is driven by the driving roller through the web W. Even in this configuration, among the pair of pressing rollers, the pressing roller positioned at the upper portion is positioned on the downstream side of the pressing roller positioned at the lower portion in the horizontal component of the transfer direction of the web W, and thus the same effects as those of the embodiments described above can be obtained.

The entire disclosure of Japanese Patent Application No. 2014-194909, filed Sep. 25, 2014 is expressly incorporated by reference herein.

What is claimed is:

1. A sheet manufacturing apparatus comprising:

a defibrating unit configured to defibrate a material including fibers in air;

a deposition unit configured to deposit at least a part of defibrated materials defibrated by the defibrating unit in the air onto a belt; and a pressing unit configured to press the deposited material that is deposited by the deposition unit;

an intermediate transfer unit comprising a transfer belt, stretching rollers, and a suction chamber, wherein the intermediate transfer unit is configured to peel the deposited material deposited onto the belt by the deposition unit and transport the deposited material to the pressing unit by upward airflow generated by the suction chamber, wherein the generated airflow is configured to cause the deposited material to be adhered to the transfer belt and the transfer belt is configured to move the deposited material toward the pressing unit by rotation of the stretching rollers;

wherein the pressing unit includes a pair of pressing rollers that presses the deposited material, wherein the pair of pressing rollers include a first pressing roller and a second pressing roller, wherein the first and second pressing rollers engage each other and wherein the first pressing roller is positioned on a downstream side of the second pressing roller in horizontal component of a transfer direction of the deposited material, and wherein the second pressing roller is configured to initially contact the deposited material that has fallen from the intermediated transfer unit and direct the deposited material to the first pressing roller that contacts the deposited material which is supported by the second pressing roller.

2. The sheet manufacturing apparatus according to claim 1, wherein, when the pair of pressing rollers is viewed in a direction of a rotational central axis of the pair of pressing rollers, an angle formed by a vertical line and a line connecting each rotational central axis of the pair of pressing rollers is 20 degrees to 90 degrees.

3. The sheet manufacturing apparatus according to claim 1, wherein the pair of pressing rollers is rotated independently from each other.

4. The sheet manufacturing apparatus according to claim 3, wherein a rotational speed of the first pressing roller is faster than a rotational speed of the second pressing roller.

5. The sheet manufacturing apparatus according to claim 3, wherein a friction coefficient of the first pressing roller positioned is greater than a friction coefficient of the second pressing roller.

6. The sheet manufacturing apparatus according to claim 1, further comprising:

a guide member configured to guide the deposited material to the pair of pressing rollers, the guide member positioned on an upstream side of a portion that nips the deposited material in the transfer direction of the deposited material.

7. The sheet manufacturing apparatus according to claim 1, wherein the first pressing roller is positioned on a first side of the deposited material and is positioned on the downstream side of the second pressing roller, wherein the second pressing roller is positioned on a second side of the deposited material.

* * * * *